United States Patent [19]

O'Connell et al.

[11] Patent Number: 4,848,105

[45] Date of Patent: Jul. 18, 1989

[54] SELF-CLEANING LINT FILTER FOR CLOTHES WASHING MACHINE

[75] Inventors: Philip J. O'Connell; Raymond W. Rummel, both of Webster City, Iowa

[73] Assignee: White Consolidated Industries, Inc., Cleveland, Ohio

[21] Appl. No.: 224,494

[22] Filed: Jul. 25, 1988

[51] Int. Cl.[4] ..... D06F 13/02; D06F 39/10

[52] U.S. Cl. ..... 68/18 F; 210/167; 210/408; 210/411

[58] Field of Search ..... 68/18 F; 210/167, 408, 210/409, 411

[56] References Cited

U.S. PATENT DOCUMENTS

| | | | |
|---|---|---|---|
| 2,961,862 | 11/1960 | Smith | 68/18 F |
| 2,976,711 | 3/1961 | Smith | 68/18 FA X |
| 3,352,130 | 11/1967 | Landwier | 68/18 F |
| 3,626,728 | 12/1971 | Traube et al. | 68/18 F |
| 3,910,076 | 10/1975 | Ruble | 68/18 F |
| 4,075,876 | 2/1978 | Platt | 68/18 F |
| 4,357,813 | 11/1982 | Sherer et al. | 68/18 F |
| 4,455,844 | 6/1984 | McMillan et al. | 68/18 F |

*Primary Examiner*—Philip R. Coe

*Attorney, Agent, or Firm*—Pearne, Gordon, McCoy & Granger

[57] ABSTRACT

A clothes washing machine of the vertical axis type has a self-cleaning lint filter integral with the spin tub. The spin tub is formed as a unitary piece from plastic material, and includes a central hub and radially outer bottom wall which are interconnected by a plurality of radially extending ribs. The ribs have spaces between them defining an annular gap, and an annular perforated lint filter is secured in the gap. An oscillating agitator within the spin tub has downwardly projecting vanes on the lower outer surface of its skirt portion which, as the agitator oscillates, cooperate with the spin tub ribs to form a pumping action to pump liquid upwardly through the lint filter and out to the interior of the spin tub. When the agitator and spin tub go into a spin mode, the centrifugal force washes the lint on the underside of the lint filter off into the fluid being pumped to drain.

18 Claims, 5 Drawing Sheets

SELF-CLEANING LINT FILTER FOR CLOTHES WASHING MACHINE

BACKGROUND OF THE INVENTION

This invention relates generally to clothes washing machines of the vertical axis, center-post agitator type, and more particularly to an automatic self-cleaning lint filter arrangement for separating the lint during the washing action to prevent redeposition on the clothes.

Automatic clothes washing machines of this type have a stationary outer tub mounted in a cabinet and accessible through a door on the top surface. Mounted within the stationary tub is a spin tub or basket within which is mounted on the central vertical axis an agitator having radially extending vanes. During washing or rinsing action, the spin tub is generally held stationary or prevented from rotating in its normal direction while the agitator is oscillated back and forth to provide the necessary washing action. To extract the water from the clothes so that they may be further dried, the spin tub is rotated at the high rate of speed so that centrifugal force forces the water outward through perforations in the side wall of the spin tub in the outer tub from which it is pumped to drain. Generally the washing machine has a transmission driven by a bidirectional electric motor which functions so that when the motor is rotated in one direction the transmission drives the agitator in its reciprocating motion, and when the motor is reversed, the transmission drives the spin tub and agitator as a unit to provide the water extraction action. The water can be drained during the spin cycle by a pump driven directly by the motor, and which functions to pump water out of the tub only when it is rotating in the spin direction.

One particular problem with the washing action of such automatic clothes washer is that of lint, which may occur on the surface of the clothes to be washed and may be produced to some degree by the washing action. Unless the lint is separated, it remains mixed with the clothes and will be redeposited on them during the spin operation. Accordingly, several methods have been proposed to provide a filtering action to separate the lint during the washing cycle so that the lint can be separated from the wash water for later disposition.

One method of providing a lint filter is to take advantage of the fact that the pump may be driven in both directions by the bidirectional motor that functions only during the spin cycle to withdraw water from the outer tub. The pump may be provided with a secondary pumping mechanism in a second chamber which functions when the motor is rotating in the opposite direction during the wash cycle, and thus pumps water from the drain at a very low rate and recirculates it back to the tub after passing through an external lint filter which may be removed from the machine and cleaned at the end of a complete clothes washing cycle. Such filters depend upon the efficiency of a recirculating pump, which has disadvantages in that it may produce excessive aeration and problems with high sudsing detergents, as well as requiring a separate cleaning action which, if forgotten by the user, may result in the filter's becoming completely clogged and ineffective.

One arrangement which avoids the use of a recirculating pump is to use the flow of water around and through the agitator, as shown in T. R. Smith U.S. Pat. No. 2,976,711. By providing an internal flow within the agitator, a separable lint filter can be mounted in the center and is easily removed for cleaning at the end of a wash cycle.

The arrangement described above still requires removal and cleaning of a lint filter, and various efforts have been proposed to provide a lint filter which has a self-cleaning action so that the user does not have to remember to perform the filter cleaning operation at the end of each wash cycle.

One approach has been to provide a filter in the bottom surface of the spin tub close to the central bearing hub, and is shown in the U.S. Pat. No. 3,352,130 of W. G. Landwier and E. B. Ruble U.S. Pat. No. 3,910,076. In these washing machines a plurality of openings are spaced around the bottom wall of the basket and mount screen-type filter elements having a suitable size perforation to allow water to float freely therethrough but cause the lint to collect on the bottom surface. With this arrangement, the agitator has a plurality of radial vanes on the undersurface adjacent the bottom wall of the spin tub radially outward from the lint filter openings. As the agitator oscillates back and forth, these vanes provide a pumping action, causing water in the outer tub to be pumped upwardly through the individual filters to the interior of the spin tub, from which it can recirculate back to the outer tub through the various openings. When the spin tub goes into a high rate of spin, the centrifugal force will cause the water to flow radially outwardly across the bottom surface of the lint filters so that the lint is then drawn off with the drain water through the pump. However, such arrangements tend to make it rather costly to manufacture the individual filter elements, and the presence of the large number of large openings in the bottom wall of the spin tub at this point may cause a serious structural weakness and possible flexing and failure of the material of the spin tub.

Another approach to overcome the above problems is shown in patents of R. B. Sherer et al. U.S. Pat. No. 4,357,813 and S. L. McMillan et al. U.S. Pat. No. 4,455,844. These arrangements allow the use of much smaller holes in the bottom wall of the tub and use the vanes on the underside of the agitator for a pumping action. However, the filter itself is maintained on a separate plastic filter element attached to the underside of the spin tub and providing the necessary filter screen and flow passages so that the water flows upwardly through the filter, radially inwardly along the passages, upwardly through smaller openings in the bottom wall of the spin tub near the hub, and then back into the interior through the pumping action of the agitator vanes.

All of the foregoing prior art arrangements have been employed with spin tubs made from metal, such as steel, and generally protected by porcelain enamel. Recently, it has been proposed to utilize spin tubs that are formed from a suitable plastic material such as a filled polypropylene in which the tubs can be manufactured by injection-molding and require little additional finishing or preparation. Such plastic spin tubs can result in a reduced manufacturing cost, as well as improved performance, by being free of rust without further treatment. However, this requires that the design of the spin tub be reconsidered because of the change of materials, and thus none of the prior art solutions to the selfcleaning lint filter problem have proved satisfactory with a plastic spin tub.

SUMMARY OF THE INVENTION

The present invention is applied to a vertical axis, center-post agitator washing machine of generally conventional configuration in which the basic mechanism is mounted for resilient movement within a cabinet, and includes a framework and an outer tub, with the framework carrying a reversible motor, pump, and drive transmission, with the drive shafts extending upwardly through the bottom wall of the stationary outer tub. Within the outer tub is located a spin tub formed from plastic material which can be rotated in one direction by the transmission during spin action, but which generally stays stationary during the washing action, which is performed by an agitator mounted within the spin tub and also driven by the transmission in an oscillating mode, depending upon the direction of rotation of the motor, and the action of the transmission.

The spin tub, being preferably formed as a unitary piece of thermoplastic material, has relatively thick walls extending upwardly from a bottom wall to an open upper end, and which may be reinforced by ribs for additional stiffness. The bottom wall of the spin tub has an outer part extending radially inward from the outer wall and a central hub which is rotatably supported on a driving shaft from the transmission. The outer part of the bottom wall is radially spaced from the central hub by an annular gap or space and interconnected by means of heavy ribs extending from the hub to the outer portion of the bottom wall and bridging the annular gap on the lower surface. These ribs are relatively thin in a peripheral direction, but thick in a vertical direction, to provide adequate stiffness so that the tub, including the side wall and the bottom wall, has minimum flexure with respect to the central hub as the tub spins at a high rate of speed with unbalanced loads.

The lint filter takes the form of an annular sheet of plastic material having a large number of small perforations extending therethrough and fits within the annular gap directly beneath the ribs. The plastic material of the filter is attached to the tub, preferably by means such as sonic welding or heat welding to provide an integrated, one-piece unit with the tub. The agitator overlies the central area of the bottom wall and has a skirt which flares radially outwardly and downwardly to a point beyond the ribs and the annular gap, and a plurality of radially extending and downwardly projecting vanes are formed on the underside of this skirt. The plastic spin tub is also provided with suitable openings in the side wall and in the bottom wall radially outwardly of the skirt of the agitator to permit water to flow from the interior of the spin tub into the outer area between the spin tub and the stationary tub.

When the machine is in the wash portion of the cycle where the spin tub does not rotate, the oscillating action of the agitator causes the vanes on the underside of the agitator skirt to cooperate with the ribs on the spin tub to provide a pumping action which forces water from the underside of the spin tub upwardly through the lint filter, and then radially outwardly through the space between the skirt and the bottom wall of the spin tub into the interior portion of the spin tub, from which the water then flows through the various openings back into the space between the spin tub and the stationary tub. As a result of this water flow, any lint tends to accumulate on the bottom side of the annular lint filter member, since the perforations are too small to allow larger lint particles to flow into the interior of the spin tub.

When the washing machine goes into a spin cycle, both the spin tub and the agitator, which now is held relatively stationary with respect to the spin tub, rotate together as a unit at a relatively high speed. Because of the lack of relative movement between the agitator and the spin tub, the pumping action is discontinued and there is no tendency for the water to flow upwardly through the openings in the lint filter. Because the high rate of speed tends to produce a centrifugal force in an outward direction, even though the lint filter is close to the axis of rotation, the water flow in this direction then tends to wash lint off the lower side of the lint filter and radially outward into the space between the bottom wall of the spin tub and the bottom wall of the outer tub. During the spin action, this water is then pumped to drain by the washing machine pump, and the lint flows with it out of the interior of the washing machine.

DESCRIPTION OF THE PREFERRED EMBODIMENT

Figure 1:
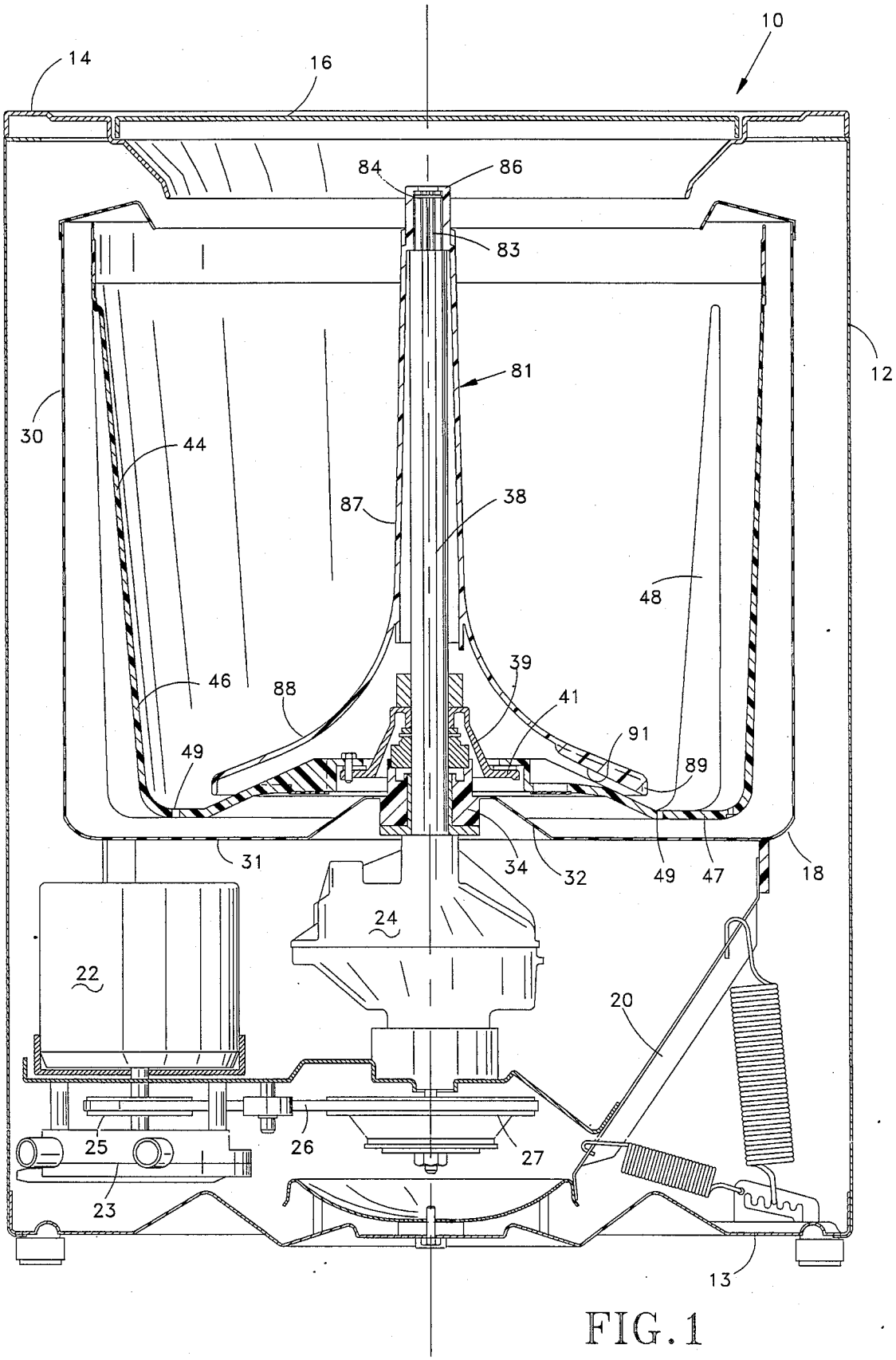
FIG. 1 is a vertical cross-sectional view through a clothes washing machine embodying the lint filter of the present invention.
Figure 3:
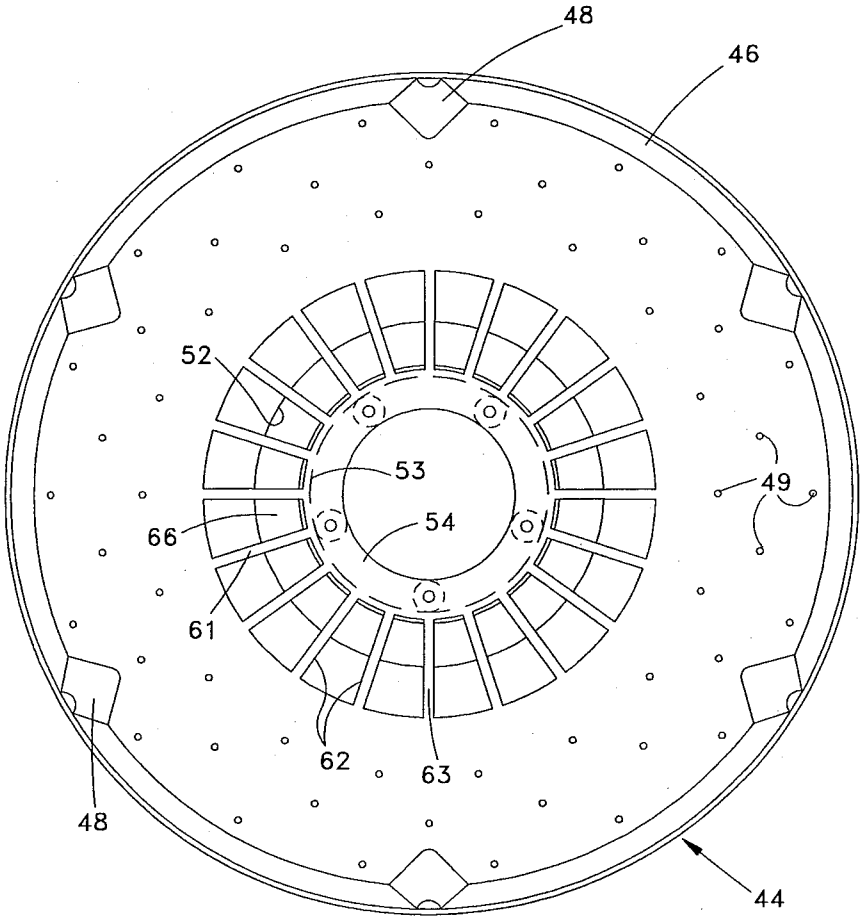
FIG. 3 is a plan view of the spin tub of FIG. 2.
Figure 2:
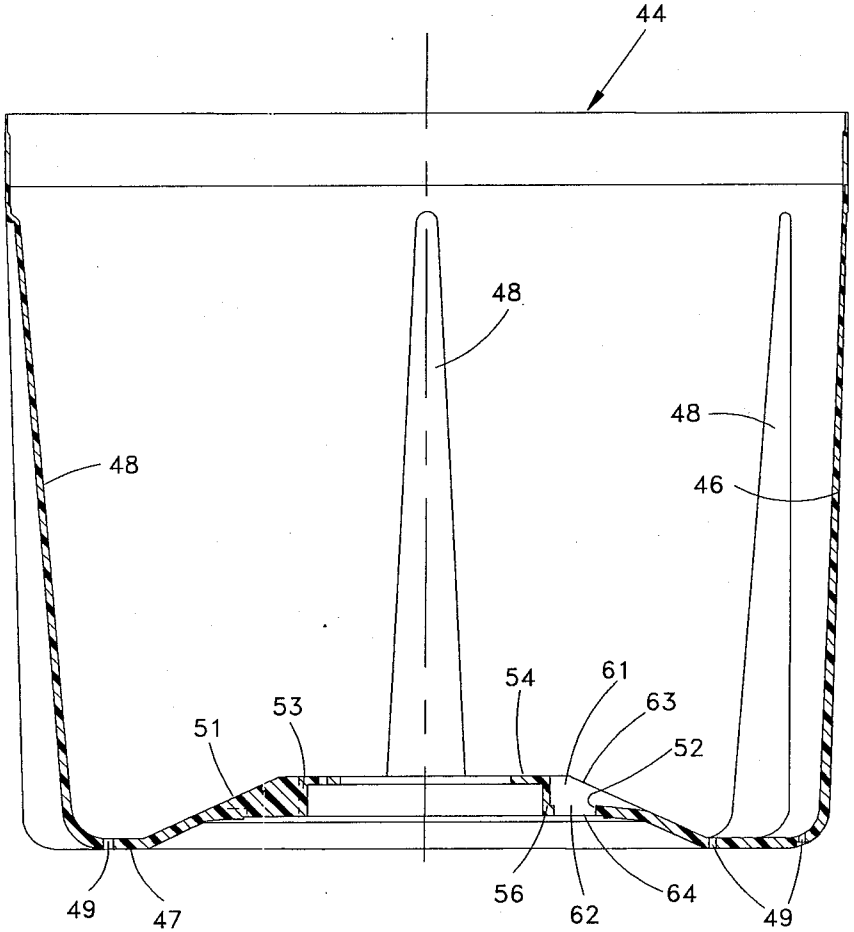
FIG. 2 is a vertical cross section through the spin tub of the washing machine of FIG. 1 prior to assembly of the lint filter.

FIG. 1 shows a washing machine 10 of the vertical axis type, which includes a cabinet 12 having a base 13 and a top 14 which defines an opening for access to the interior that is closed off by the hinged lid 16. The mechanism within the cabinet 12 includes an outer tub 18 which is imperforate and may be made of either metal or plastic to contain the washing liquid. The tub 18 is mounted on a support frame 20, which is in turn supported on the base 13, and which also serves to support a bidirectional drive motor 22 which drives a pump 23 connected to the outer tub 18 for evacuating the water to drain when the motor is rotated in one direction. The motor 22 has a pulley 25 connected by a V-belt 26 to a transmission pulley 27 secured to transmission 24 mounted on the support frame 20 beneath the central axis of the outer tub 18.

The outer tub 18 includes generally vertical side walls 30 and a bottom wall 31 extending generally radially inward from the bottom edge of the side walls 30 to an upwardly sloping conical portion 32 secured to a hub 34 adjacent the transmission 24. The hub 34 supports a bearing 36 within which is rotatably mounted a drive tube 38. A drive hub 39 is nonrotatably secured to the drive tube 38 above the outer tub hub 34 and bearing 36, and is provided with suitable seals to prevent the escape of water through the bearing 36. Drive hub 39 includes a radially extending flange 41 for mounting the spin tub, as described in greater detail hereinafter.

The spin tub 44 is mounted for rotation about the axis of the drive tube 38, and in the present invention is preferably formed from a suitable plastic material such as a talc-filled polypropylene. This material has many advantages in that it allows the tub to be formed by an injection molding operation with a minimum of finishing operations to reduce cost, and has the additional advantage that it will not rust or corrode in use. Thus, the use of this plastic material for the spin tub eliminates the need for extensive fabricating operations required for metal spin tubs and, unless stainless steel is used, the need to apply a porcelain enamel coating on top of the fabricated steel to prevent rust. Howeve,r the use of a plastic material such as polypropylene has required a complete redesign of the tub in view of the reduced strength of the plastic material as compared to steel.

The spin tub 44 is provided with a vertically extending, generally cylindrical side wall 46 which may have an outward taper toward the upper end and may be provided with flutes or ribs 48 extending vertically at spaced locations to provide additional stiffness. The tub includes an outer bottom wall 47 integrally joined to the side wall 46, and extending generally radially inwardly from the side wall 46 for a spaced distance. Suitable perforations 49 may be formed in both the outer bottom wall 47 and the side wall 46 to allow the flow of water from the interior of the spin tub 44 to and from the outer tub 18. Inwardly from the outer bottom wall 47 is an upwardly sloping, conical portion 51 which terminates in a circular inner edge 52 a spaced distance from the axis of rotation. The tub 44 also includes a hub portion 53 having a radial flange 54 and a vertical cylindrical wall 56, with the flange 54 resting on a gasket 57 on top of the drive hub flange 41 to which it is secured by bolts 58.

The hub 53 is connected to the outer bottom wall 47 by means of a plurality of radially extending ribs 61 having parallel, vertically extending sides 62, giving a transverse thickness that is relatively small compared to the vertical extent between the rib top edge 63, which slopes downward toward the upper surface of the outer bottom wall 47, and the radially extending rib undersurface or edge 64, which is spaced a predetermined distance above the lower edge of the conical portion inner edge 52.

The space between the inner edge 52 and the hub vertical wall 56 defines an annular gap 66 which is thus covered only by the bridging of the radial ribs 61 and leaves sector-shaped spaces therebetween. A notch or recess 67 is formed on the lower inside corner of the edge 52 to receive the filter ring 71, which is also seated on the bottom edge 68 of vertical wall 56 and against the bottom edges 64 of the radial ribs 61.

Figure 5:
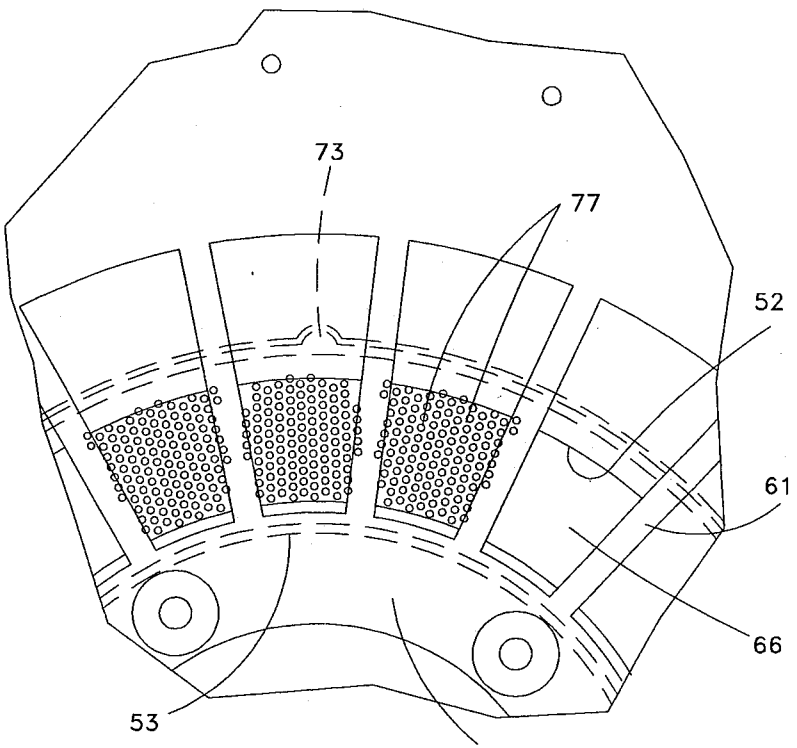
FIG. 5 is an enlarged, fragmentary plan view similar to FIG. 3 but showing the lint filter assembled in place.
Figure 4:
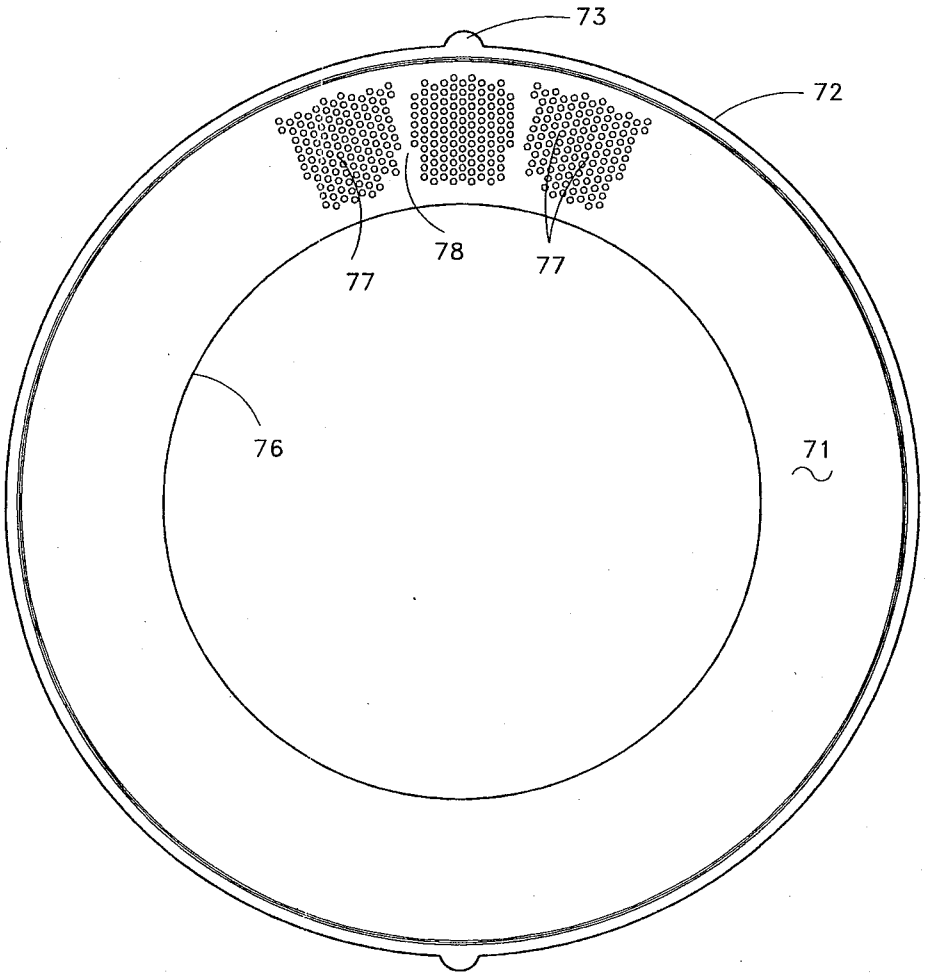
FIG. 4 is a plan view of the lint filter prior to assembly.
Figure 6:
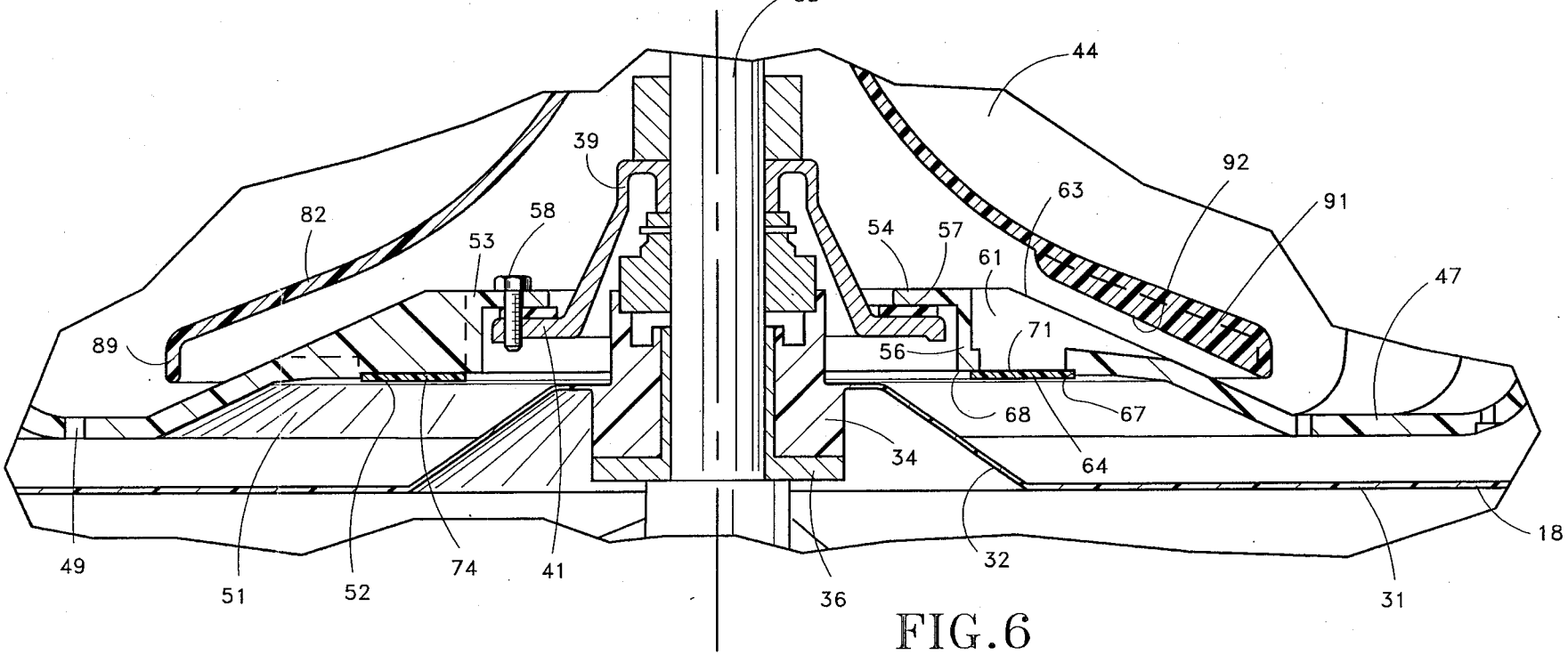
FIG. 6 is an enlarged, fragmentary cross-sectional view of the lint filter area of the washing machine shown in FIG. 1.
Figure 7:
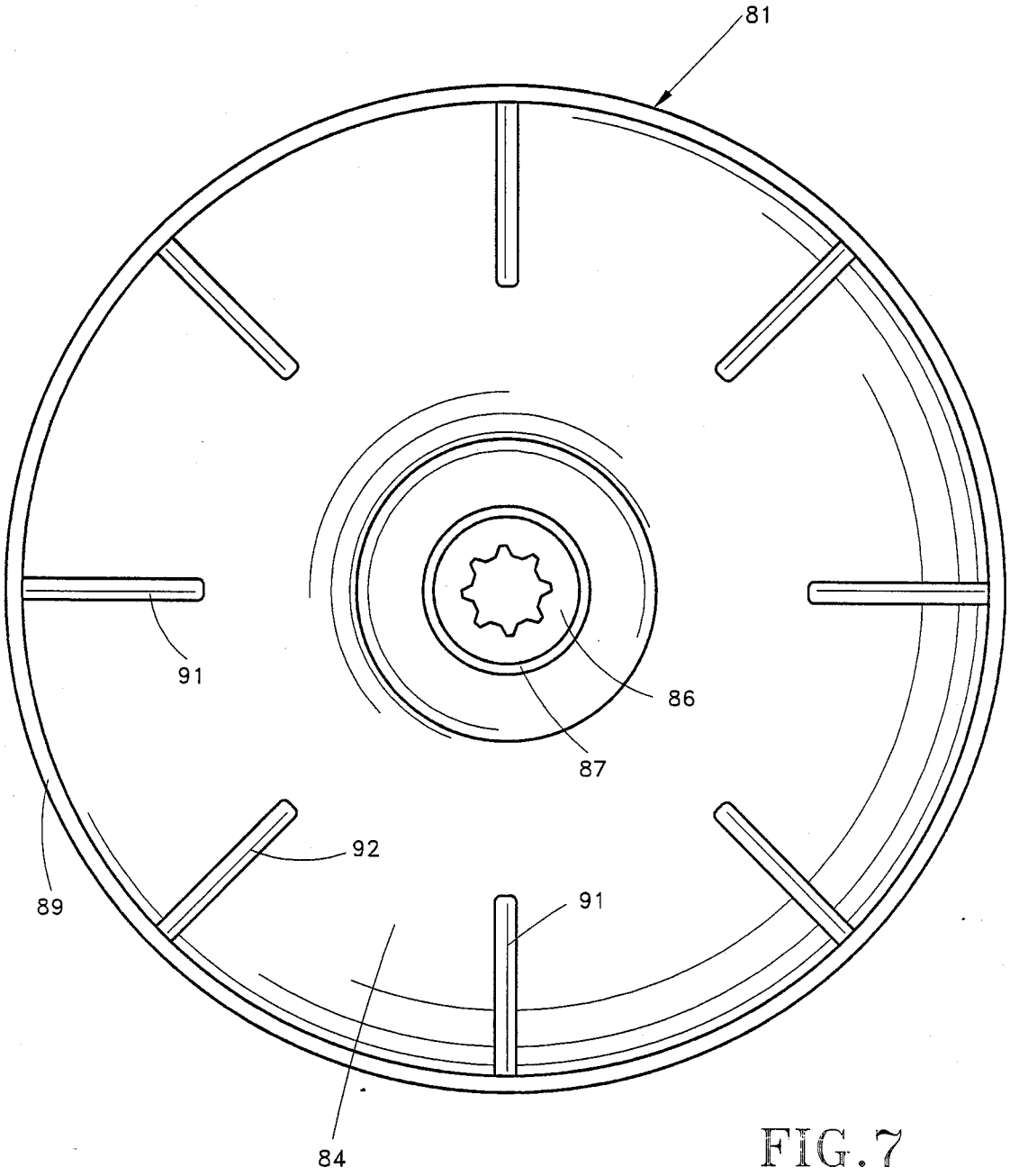
FIG. 7 is a bottom view of the agitator shown in FIGS. 1 and 6.

The filter ring 71 is formed as an annular sheet conforming to the bottom of the spin tub, and has a circular outer edge 72 adapted to fit within the recess 67 so that the bottom surface 74 is smooth and substantially flush with the bottom surface of the outer bottom wall 47. This edge may be provided with several projecting tabs 73 which engage mating recesses in the tub for precise location of the filter ring within the annular gap 66 during assembly. The filter ring 71 has an inner edge 76 which abuts against the bottom edge 68 of vertical wall 56 to thus effectively seal the annular gap 66. The filter ring 71 is preferably, during assembly, secured in place by means of ultrasonic welding or heat-sealing to ensure a sealing engagement at the outer and inner edges 72 and 76 with the material of the tub, and therefore the filter ring is preferably also made of a polypropylene material similar to that of the spin tub 44. As shown in FIGS. 4 and 5, the filter ring 71 is provided with a large number of perforations 77 generally distributed over the open space between the ribs 61 and, for purposes of strength, is provided with blank spaces indicated at 78 where the filter contacts the bottom edges 64 of the ribs. Thus, the perforations 77 completely cover almost all of the sectors in the annular gap 66 between the ribs and between the inner edge 52 and vertical wall 56. These perforations 77 allow the water to flow upwardly from the space between the spin tub 44 and the outer tub 18 into the interior of the spin tub, as described hereinafter.

The washing action and the pumping of the water upward through the lint filter are accomplished by an oscillating agitator 81 mounted within the spin tub 44. A drive shaft 83, driven by transmission 24, extends upward through drive tube 38 and has a splined end portion 84 extending beyond the upper end of the drive tube. Agitator 81 includes a hub 86 which incorporates splines that mate with the splined end 84 so that the agitator can oscillate with the drive shaft 83. Agitator 81 also includes a hollow shaft portion 87 extending downwardly around the drive tube 38, and the shaft portion 87 may include various projecting vanes (not shown) for agitating the water and the clothes in the well-known manner. At its lower end, shaft portion 87 extends and flares downwardly and outwardly into an integral skirt portion 88 which terminates in a circular, downward1y extending rim 89 adjacent the inner edge of the spin tub outer bottom wall 47. The skirt portion 88 is generally of uniform thickness, and provides a generally smooth upper surface to avoid snagging the clothes. On its underside, extending radially inward from the rim 89 are located a plurality of radial vanes 91 which have bottom edges 92 that extend generally parallel to but a spaced distance above the top edges 63 of the radial spin tub ribs 61.

When the washing machine is in the wash mode, the motor 22 rotates in a first direction, and the transmission 24 operates in such a manner that the drive tube 38, and hence the spin tub 44, are generally held stationary, while the drive shaft 83 and agitator 81 are oscillated through a predetermined stroke at a fixed speed. As the agitator 81 moves with respect to the spin tub 44, the vanes 91 on the underside of the agitator are therefore moved back and forth with respect to the radial ribs 61 on the spin tub, and this provides a pumping action which forces the water radially outwardly and downwardly from beneath the skirt portion 88 into the main portion of the spin tub, which will cause water to flow outwardly through the perforations 49 into the space between the spin tub 44 and outer tub 18. As a result of this pumping of water in a radially outward direction, a makeup flow takes place upwardly through the filter ring 71 as the water within the outer tub 18 circulates back into the interior of the spin tub. Because of the small size of the perforations 77 and the filter ring 71, threads and fibers tend to accumulate on the bottom surface 74 of the filter ring 71 as long as the wash mode is in operation.

When the motor 22 is rotated in the opposite direction, the operation of the transmission 24 is such that both the drive tube 38 and the drive shaft 83 rotate together as a unit. Thus, the agitator 81 no longer moves with respect to the spin tub 44 as they are driven to a relatively high rotational spin speed in the range of say 500 to 600 rpm, and therefore there is no longer any pumping action to cause an upward flow of water through the filter ring 71. However, at this high rate of spin, the tendency is for the water to flow outward to perforations in the side wall 46 of spin tub 44 to accumulate within the outer tub 18, where it is pumped to drain by pump 23. As the water is pumped out and the level lowers, the centrifugal spinning action at the filter ring 71 causes a radially outward flow along the bottom surface 74 of the filter ring and the accumulated lint and fibers on this surface are washed off into the water in the space between the outer tub 18 and spin tub 44, where they are pumped to drain as they remain suspended in the water.

It will be seen that the lint filter and spin tub construction described above provide an effective filtering arrangement which operates at all times during the wash cycle and is cleaned each time the machine goes into a spin cycle, and utilizes a construction particularly adapted to a plastic spin tub construction; however, it is recognized that a similar construction could be fabricated in metal or any other nonmetallic material of sufficient strength and still be within the scope of the present invention as defined in the claims.

What is claimed is:

1. A clothes washing machine of the vertical axis type having a stationary outer tub, a spin tub mounted within said outer tub for rotation about said vertical axis, said spin tub having a central hub and a bottom wall, a plurality of ribs extending radially outward from said central hub and upward from said bottom wall, said bottom wall having flow passages between said ribs, perforated lint filter means secured to said bottom wall to allow fluid to flow upward through said flow passages into the interior of said spin tub, an oscillating agitator mounted within said spin tub and having a skirt portion extending radially outward over said ribs and said bottom wall, and radially extending vanes on the lower surface of said skirt portion extending downward adjacent said ribs to cooperate with said ribs when said agitator is oscillated with respect to said spin tub to pump fluid upward through said lint filter means.

2. A clothes washing machine as set forth in claim 1, wherein said lint filter means is an annular sheet secured to the lower surface of said bottom wall.

3. A clothes washing machine as set forth in claim 2, wherein said lint filter means engages the lower surface of said ribs.

4. A clothes washing machine as set forth in claim 3, wherein said lint filter means is welded to said bottom wall along its radially inner and outer edges.

5. A clothes washing machine of the vertical axis type having a stationary outer tub, a spin tub mounted within said outer tub for rotation about said vertical axis, said spin tub having a central hub and an outer portion, said outer portion including a bottom wall extending radially inward toward said central hub and being spaced therefrom by an annular gap, a plurality of radially extending ribs interconnecting said central hub and said bottom wall, said ribs defining flow passages therebetween, an annular lint filter secured in said annular gap to make a sealing fit with said central hub and said bottom wall, said lint filter having a perforated wall to allow fluid to flow upward through said flow passages into the interior of said spin tub, an oscillating agitator mounted within said spin tub and having a skirt portion extending radially outward over said ribs and said bottom wall, and radially extending vanes on the lower surface of said skirt portion extending downward adjacent said ribs to cooperate with said ribs when said agitator is oscillated with respect to said spin tub to pump fluid upward through said lint filter.

6. A clothes washing machine of the vertical axis type having a stationary outer tub, a unitary plastic spin tub mounted within said outer tub for rotation about said vertical axis, said spin tub having a central hub and an outer portion, said outer portion including a perforated side wall and a bottom wall extending radially inward from said side wall toward said central hub and being spaced therefrom by an annular gap, said spin tub including a plurality of radially extending ribs interconnecting said central hub and said bottom wall, said ribs defining flow passages therebetween at said annular gap, an annular plastic lint filter secured in said annular gap to make a sealing fit with said central hub and said bottom wall, said lint filter having a perforated wall to allow fluid to flow upward through said flow passages into the interior of said spin tub, an oscillating agitator mounted within said spin tub and having a skirt portion extending radially outward over said ribs and said bottom wall, and radially extending vanes on the lower surface of said skirt portion extending downward adjacent said ribs to cooperate with said ribs when said agitator is oscillated with respect to said spin tub to pump fluid upward through said lint filter from the space between said outer tub and said bottom wall.

7. A clothes washing machine as set forth in claim 6, wherein said lint filter is an annular sheet welded at its inner and outer edges to said central hub and said bottom wall.

8. A clothes washing machine as set forth in claim 7, wherein said sheet abuts the lower edges of said ribs.

9. A clothes washing machine as set forth in claim 8, wherein said sheet is perforated between said ribs and imperforate adjacent said ribs.

10. A clothes washing machine as set forth in claim 6, wherein said ribs and said lint filter provide the only interconnection between said central hub and said bottom wall.

11. A clothes washing machine as set forth in claim 10, wherein said ribs have parallel vertically extending sides.

12. A clothes washing machine as set forth in claim 11, wherein said ribs have upper edges extending parallel to the lower edges of said vanes.

13. A clothes washing machine as set forth in claim 5, wherein said ribs and said lint filter provide the only interconnection between said central hub and said bottom wall.

14. A clothes washing machine as set forth in claim 5, wherein said ribs have parallel vertically extending sides.

15. A clothes washing machine as set forth in claim 14, wherein said ribs have upper edges extending parallel to the lower edges of said vanes.

16. A clothes washing machine as set forth in claim 5, wherein said lint filter is a sheet secured to the lower surface of said bottom wall and said central hub.

17. A clothes washing machine as set forth in claim 16, wherein said lint filter engages the lower surface of said ribs.

18. A clothes washing machine as set forth in claim 17, wherein said lint filter is welded to said bottom wall along its radially outer edge and to said central hub along its radially inner edge.

* * * * *